US006686527B2

(12) United States Patent
Hagiwara

(10) Patent No.: US 6,686,527 B2
(45) Date of Patent: Feb. 3, 2004

(54) TIGHTENING FRAME FOR A DRUM

(75) Inventor: Takashi Hagiwara, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 10/161,811

(22) Filed: Jun. 4, 2002

(65) Prior Publication Data

US 2002/0194978 A1 Dec. 26, 2002

(30) Foreign Application Priority Data

Jun. 11, 2001 (JP) ..... 2001-176364
Jun. 11, 2001 (JP) ..... 2001-176367

(51) Int. Cl.[7] ..... G10D 13/02
(52) U.S. Cl. ..... 84/413; 84/411 R; 84/411 A
(58) Field of Search ..... 84/413, 411 R, 84/411 A

(56) References Cited

U.S. PATENT DOCUMENTS 4,475,434 A * 10/1984 Willis ..... 84/411 R
6,492,583 B1 * 12/2002 Wilkey ..... 84/413

* cited by examiner

*Primary Examiner*—Shih-Yung Hsieh
(74) *Attorney, Agent, or Firm*—Koda & Androlia

(57) ABSTRACT

A drum tightening frame having bolt attachment openings disposed in a circular plate portion of the tightening frame, the bolt attachment openings being arc-shaped slots closed at both ends, and each of these openings comprising a primary opening section through which the shank (and not the head) of a corresponding tightening bolt is passed and a secondary opening section which communicates with one end of the primary opening section and has a size that allows the head of the tightening bolt to pass through. In addition, when washers are used, the tightening frame, tightening bolts and washers can be formed so as to be magnetically attracted to each other so that the washers can stay with the tightening frame or with the tightening bolts, thus avoiding the washers from being lost when the tightening bolts are removed from the drum body.

4 Claims, 5 Drawing Sheets

TIGHTENING FRAME FOR A DRUM

BACKGROUND OF THE INVENTION

1. Field of the Invention

The present invention relates to a drum tightening frame used in, for instance, bass drums, snare drums and marching drums and more particularly to a structure for mounting a tightening frame on a drum body.

2. Prior Art

In drums such as bass drums, snare drums, and marching drums, the drumheads are supported and tensioned by a plurality of head supporting and tensioning assemblies, and a specified tensile force is applied to the drumheads.

FIG. 5 shows a conventional snare drum (upside-down), and FIG. 6 shows the essential portion of the head supporting and tensioning assembly of the drum.

The reference numeral 1 is a drum main body that is cylindrical and opened at both ends. The reference numeral 2 refers to drumheads (2*a* and 2*b*), and 3 refers to a head supporting and tensioning assembly for the drumheads 2.

The head supporting and tensioning assembly 3 is comprised of an annular head frame 5, which is mounted on the external surface of the drum main body 1, and an annular tightening frame (rim) 6, which is likewise mounted on the external surface of the drum main body 1. The head supporting and tensioning assembly 3 further includes a plurality of lugs 7, which are fastened to the external surface of the drum main body 1, and tightening bolts 8, which connect the respective lugs 7 and the tightening frame 6.

With the structure above, the drumheads 2 are adjusted, in other words, the tone color of the snare drum 10 is adjusted, by turning the tightening bolts 8 with a tuning key (not shown) so that the tightening frame 6 is pressed against the head frame 5, thus moving the head frame 5 in the axial direction of the drum main body 1.

In FIGS. 5 and 6, the reference numeral 2*a* refers to the drumhead on the front (or top) side, 2*b* refers to the drumhead on the back (or bottom) side of the drum, and 9 refers to snappies (acoustic wires) disposed on the back side drumhead 2*b*. In addition, the reference numeral 16 is a washer. A plurality of washers 16 are respectively disposed between the tightening bolts 8 and the tightening frame 6.

Typically, the tightening frame 6 is made of a metal consisting of a molded product such as aluminum, etc., and it is formed so as to have an L-shaped cross section, as best seen from FIG. 6, so that the tightening frame 6 includes a cylindrical portion 6A and a ring-form circular plate portion 6B. The cylindrical portion 6A has a diameter that is larger than the external diameter of the drum main body 1 but smaller than the external diameter of the head frame 5. The ring-form circular plate portion 6B is integrally formed with the cylindrical portion 6A, and it circumferentially extends outward at the lower end (in FIG. 6) of the cylindrical portion 6A.

A plurality of bolt attachment openings 11 are opened in the circular plate portion 6B (only one opening 11 is shown in FIG. 6) so that they positionally correspond to the respective lugs 7. Each bolt attachment opening 11 is typically round in shape, and its hole diameter is slightly larger than the external diameter of the shank 8A of the tightening bolt 8 and is slightly smaller than the diameter of the head 8B of the tightening bolt 8. The shank 8A has an externally threaded screw section 12. The bolt attachment opening 11 can be of a slot type as shown in FIG. 7. The slot type bolt attachment opening 11 extends along the external surface of the tightening frame 6' and has an arc-shape and opened at one end.

However, the above-described convention drum tightening frames 6 and 6' have problems.

In tightening frame 6 shown in FIG. 6, the heads 8B of the tightening bolts 8 cannot pass through the bolt attachment openings 11 of a round shape (since the hole diameter of each bolt attachment opening 11 is smaller than the head 8B). As a result, when the drumhead 2 is to be replaced, the tightening bolts 8 must be removed from the lugs 7 (more specifically, from the lug nuts 15 of the lugs 7), and then the tightening frame 6 and head frame 5 are removed from the drum main body 1. When the drumhead 2 is to be mounted, the head frame 5 and tightening frame 6 are first mounted on the drum main body 1, after which the tightening bolts 8 are passed through the bolt attachment openings 11 and screwed into the lug nuts 15 of the lugs 7, and then the tightening frame 6 and lugs 7 are connected by the tightening bolts 8. Such attachment and removal of the tightening bolts 8 is, however, bothersome, since the number of the tightening bolts used is relative large. Thus, a considerable amount of time is required for attaching and replacing the drumhead 2.

In the case of the tightening frame 6' shown in FIG. 7, the tightening frame 6' is turned by a specified angle so that all the tightening bolts 8 are positioned outside the slots 13, and then the tightening frame 6' is removed from the tightening bolts 8. Accordingly, there is no need to remove the tightening bolts 8 from the lugs 7, and attachment and replacement of the drumheads 2 is easier than in the tightening frame 6 of FIG. 6. The tightening frame 6' thus has a better drum handling characteristics. However, each one of bolt supporting portions 14 (that have a "J" shape when viewed from above as seen from FIG. 7) that form the outside edges of the slots 13 is in a cantilever supporting structure. Accordingly, the bolt supporting portions 14 tend to flex when the tightening bolts 8 are tightened, making it difficult to give a desired tension to the drumhead 2. Especially in cases where high-tension tuning is performed, the bolt supporting portions 14 are more likely to bend or to be damaged, thus having problems in terms of strength.

Furthermore, in cases where washers 16 are respectively disposed between the heads 8B of the tightening bolts 8 and the ring-form circular plate portion 6B of the tightening frame 6 when the drumheads 2 are to be replaced, the tightening bolts 8 must be removed from the lugs 7, and then the tightening frame 6 and head frame 5 are removed from the drum main body 1.

More specifically, when one of the drumheads 2 is to be replaced, it is necessary to disengage the tightening bolts 8 from the lugs 7 and then to remove the tightening frame 6 and head frame 5 from the drum main body 1. When, on the other hand, the drumhead 2 is to be mounted, it is necessary to mount the head frame 5 and tightening frame 6 on the drum main body 1, pass the tightening bolts 8 through the bolt attachment openings 11 with washers 16 interposed and then screw the tightening bolt 8 to the lug nuts 15 of the lugs 7 so that the tightening frame 6 is pressed against the head frame 5.

However, if the washers 16 slip off of the tightening bolts 8 and drop when the tightening bolts 8 are removed from the lug nuts 15 and pulled out of the bolt attachment openings 11 in the tightening frame 6 at the time of attachment or replacement of the drumhead 2, the washers 16 are likely to be lost. In other words, the washers 16 would roll across the floor and enter small spaces between musical devices, furniture, etc. Accordingly, a careful attention is required in the attachment and removal of the tightening bolts 8.

SUMMARY OF THE INVENTION

The present invention solves the above-described problems with conventional drums, and it is an object of the present invention to provide a drum tightening frame that allows easy attachment, stretching and removal of drumheads.

It is another object of the present invention to provide a drum tightening frame that maintains a sufficient strength even in the case of high-tension tuning and holds the drumheads with appropriate tension in a stable fashion.

It is still another object of the present invention to provide a drum tightening frame that prevents loss of washers by preventing the washers from falling off of the tightening bolts or tightening frame when the tightening bolts are removed from the tightening frame.

The above objects are accomplished by a unique structure for a tightening frame for a drum in which the tightening frame is mounted on an open end of a drum body of the drum having a plurality of lugs on its outer surface, presses a head frame for the drum by being connected to the lugs via tightening bolts, and has an integrally formed circular plate portion; and in the present invention, the circular plate portion is provided with elongated bolt attachment openings with both ends thereof closed, and each of the bolt attachment openings is comprised of: a primary opening section that extends in a circumferential direction of the tightening frame and through which only the shank of a corresponding tightening bolt can pass, and a secondary opening section that is continuously formed at one end of the primary opening section and allows the head (and the shank) of the tightening bolt to pass through.

With this structure, when the tightening frame is turned by a specified angle so that the heads of the tightening bolts are brought into the secondary opening sections, the tightening frame can be removed from the tightening bolts, and this can be done without removing the tightening bolts from the lugs. Since each of the bolt attachment openings is in an elongated or slot shape that has closed ends, the bolt attachment portion of the tightening frame in which the bolt attachment opening is formed has a sufficient rigidity, and the bolt attachment portion can sufficiently withstand eve high-tension tuning.

The above objects are further accomplished by a unique structure of the present invention in which the washers and the tightening frame or the tightening bolts are formed so as to be magnetically attracted to each other.

By way of magnetically attaching the washers and the tightening frame or tightening bolts to each other, even in cases the tightening bolts are disengaged from the lugs and from the tightening frame, the washers will not fall off and thus can be prevented from being lost.

More specifically, the washer can be a magnetized magnetic material, and either the tightening frame or the tightening bolt is made of a magnetic material.

Instead, the washer can be made of a magnetic material, and either the tightening frame or the tightening bolt is made of a magnetized magnetic material.

It is also possible to form the washer with a magnetized magnetic material and to form one of the tightening frame and tightening bolt by a magnetized magnetic material and form another of the tightening frame and tightening bolt by a magnetized magnetic material.

DETAILED DESCRIPTION OF THE INVENTION

The present invention will be described in detail below with reference to the embodiments illustrated in the accompanying drawings. The description will be made based upon a snare drum that comprises a drum main body 1, drumheads 2, and a head supporting and tensioning assembly 3.

Figure 1:
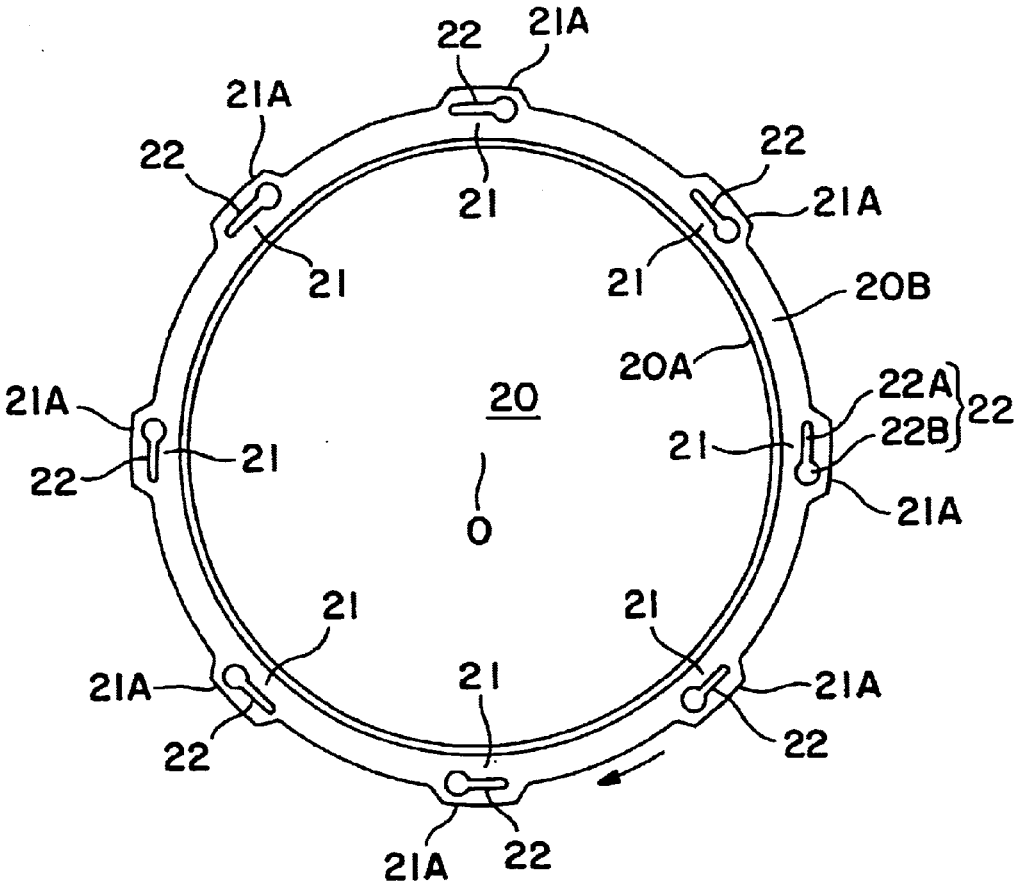
FIG. 1 is a top view of the drum tightening frame according to the present invention.
Figure 2:
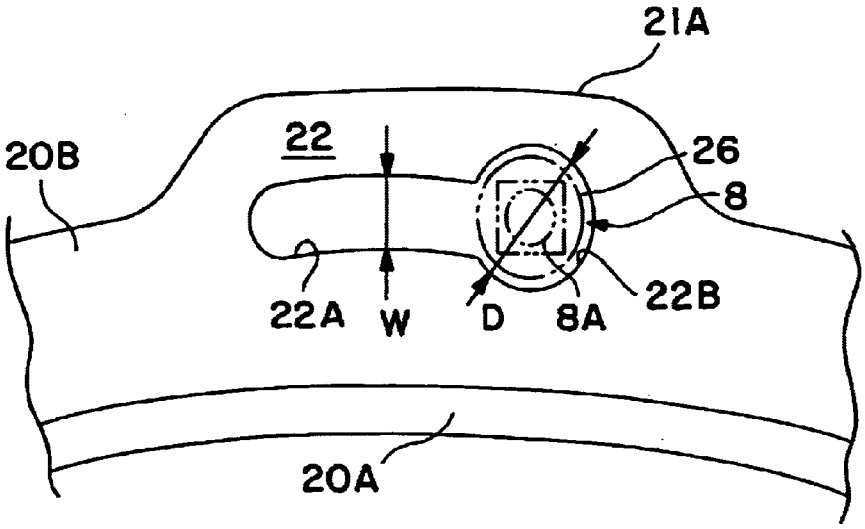
FIG. 2 illustrates one of the bolt attachment openings formed in the drum tightening frame.
Figure 3:
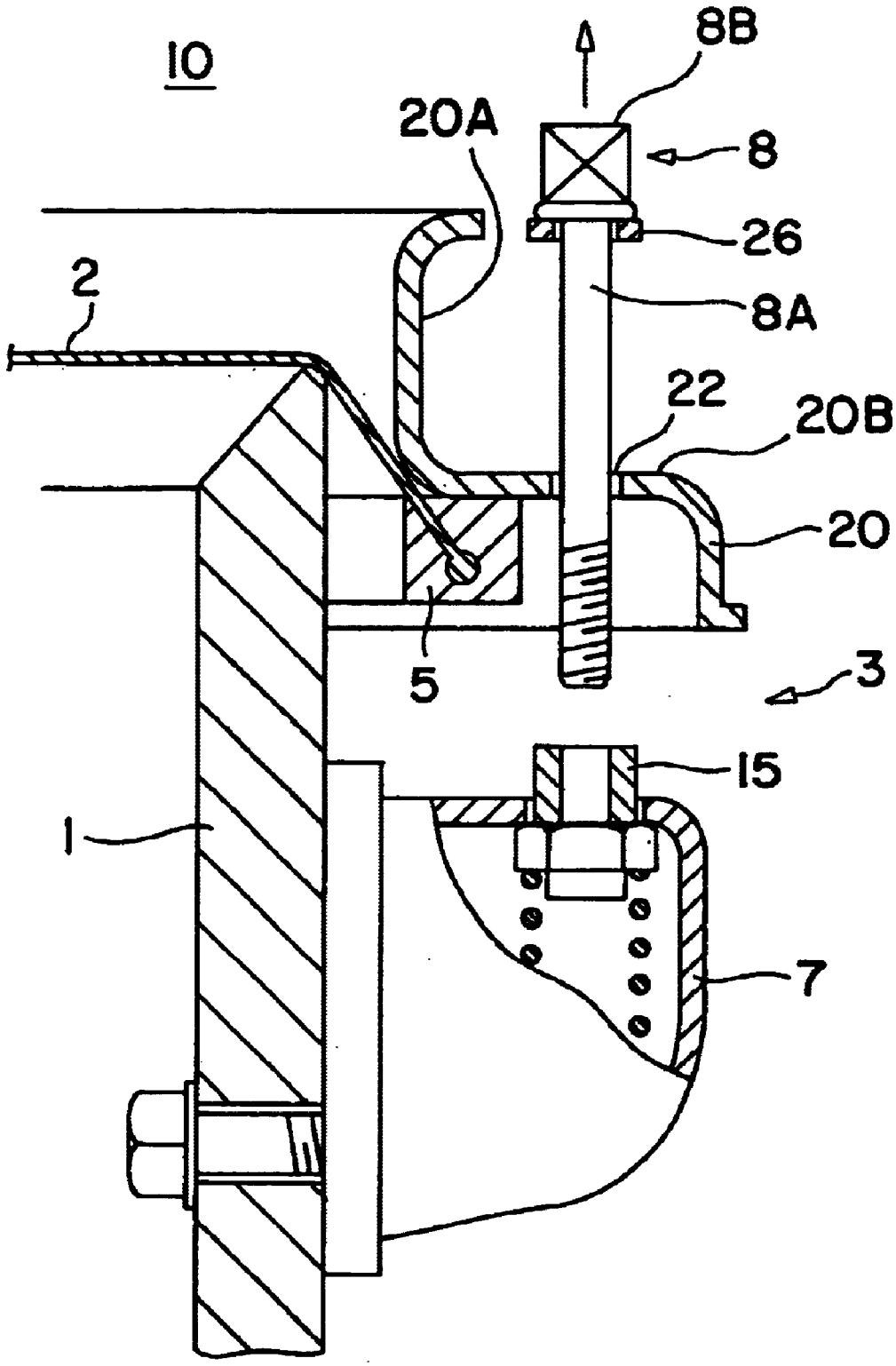
FIG. 3 is a sectional view of one embodiment of the drum tightening frame according to the present invention that uses magnetic force.
Figure 4:
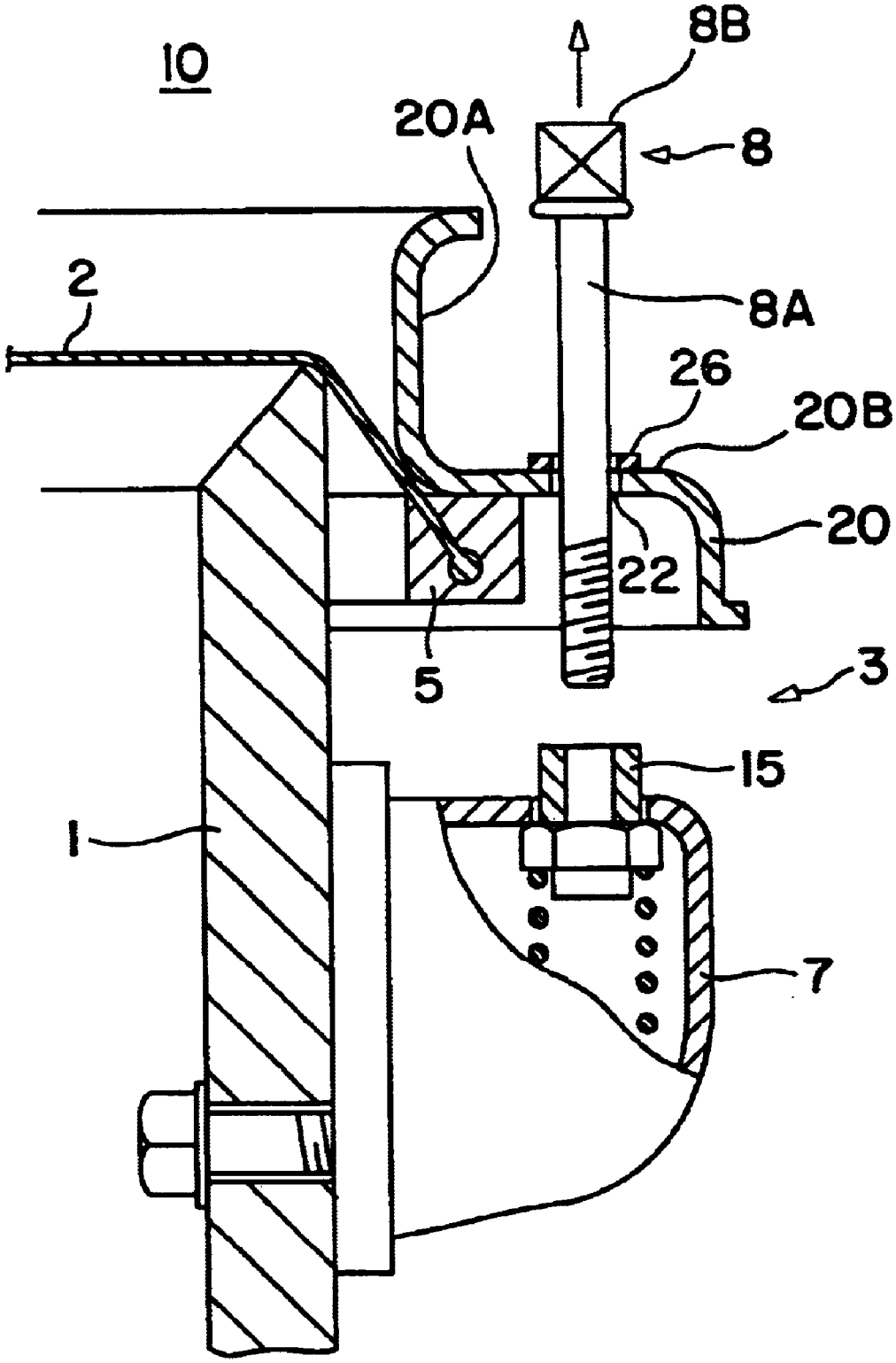
FIG. 4 is a sectional view of another embodiment of the drum tightening frame according to the present invention that uses magnetic force as well.
Figure 5:
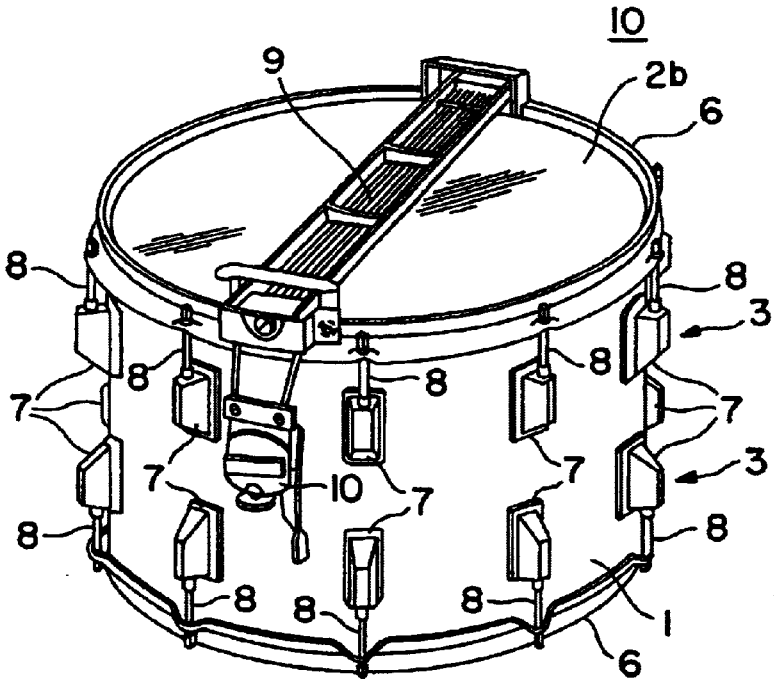
FIG. 5 PRIOR ART
FIG. 5 is an external perspective view of a conventional snare drum in an upside-down attitude, showing the bottom.
Figure 6:
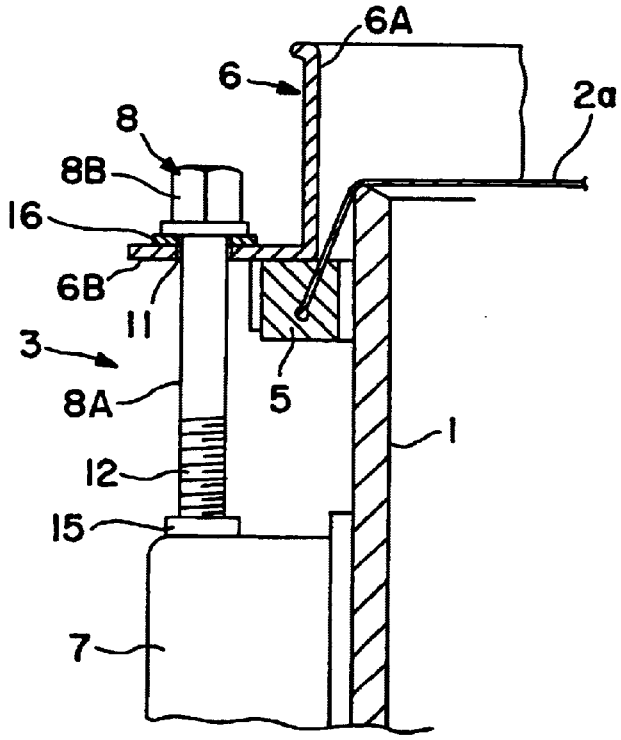
FIG. 6 PRIOR ART
FIG. 6 is a sectional view of the essential portion of the head supporting and tensioning assembly in the conventional drum.
Figure 7:
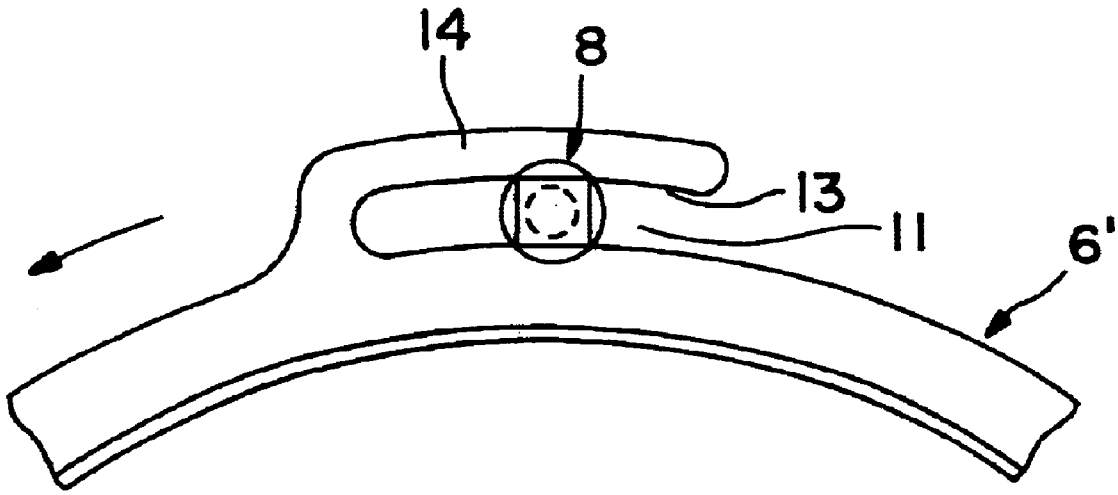
FIG. 7 PRIOR ART
FIG. 7 is a top view of the essential portion of a conventional head tightening frame.

In FIGS. 1 and 2, the drum tightening frame 20 is, in the same manner as in the conventional tightening frame 6 shown in FIG. 6, made of a metal consisting of a molded product such as aluminum, etc. and is formed in a substantially cross-sectional L shape (see FIGS. 3 and 4 or see the corresponding prior art frame 6 in FIG. 6). The drum tightening frame 20 is thus comprised of a cylindrical portion 20A and a ring-form circular plate portion 20B. The cylindrical portion 20A extends in the axial direction of the drum main body 1 and has a diameter that is larger than the external diameter of the drum main body 1 and smaller than the external diameter of the head frame 5. The ring-form circular plate portion 20B extends in the direction perpendicular to the axis of the drum maim body 1 and is integrally formed with the cylindrical portion 20A so that the ring-form circular plate portion 20B is located closer to the axial center of the drum main body 1 than the cylindrical portion 20A is. Furthermore, eight bolt attachment portions 21 that have bolt attachment openings 22 are disposed in the circular plate portion 20B of the drum tightening frame 20 at equal intervals in the circumferential direction.

Each of the bolt attachment portions 21 has an arc-shaped protruding portion 21A that protrudes outward from the outer circumference of the circular plate portion 20B. Furthermore, the bolt attachment opening 22 is formed in the boundary area between this protruding portion 21A and the circular plate portion 20B. The protruding portion 21A is formed in each bolt attachment portion 21; and this structure is taken so as to locate the bolt attachment opening 22 at positions separated from the cylindrical portion 20A and so as not to increase the external diameter of the circular plate portion 20B, thus allowing tightening bolts 8 in the bolt attachment opening 22 to be easily rotated by a tuning key (not shown).

Each of the bolt attachment openings 22 is formed in the shape of an arc that is centered at the center O of the tightening frame 20, so that each bolt attachment opening 22 takes an elongated or slot shape that is closed at both ends thereof and is comprised of a primary opening section 22A and a secondary opening section 22B. The primary opening section 22A extends in the circumferential direction of the tightening frame 20, and the secondary opening section 22B, that is a circular shape, communicates with one end of this primary opening section 22A.

The width W of the primary opening section 22A of each bolt attachment opening 22 is set so as to be slightly larger than the external diameter of the shank 8A of a tightening bolt 8 and smaller than the external diameter of the head 8B of the tightening bolt 8. The secondary opening section 22B is round having the diameter D that is greater than the external diameter of the head 8B of the tightening bolt 8 (the head 8B being larger than the shank 8A in external diameter), so that the head 8B can pass through the secondary opening section 22B. Accordingly, each bolt attachment opening 22 exhibits somewhat a keyhole shape. The tightening bolt 8 is ordinarily positioned in the primary opening section 22A, so that the tightening frame 20 is pressed against the head frame 5, thus causing a desired tension to be applied to the drumhead 2. As long as the head 8B of the tightening bolt 8 can pass through, the secondary opening section 22B can take other shapes than a circle, such as a polygonal shape.

In the tightening frame 20 equipped with such bolt attachment openings 22 that are elongated holes closed at both ends as described above, the tightening frame 20 can easily be removed from the tightening bolts 8 by (after loosening the tightening bolts 8 that are in the primary opening sections 22A of the bolt attachment openings 22) turning the tightening frame 20 by a specified angle toward the secondary opening sections 22B as indicated by an arrow in FIG. 1 so that the tightening bolts 8 are positioned in the secondary opening sections 22B. Accordingly, when the drumheads 2 are attached or replaced, there is no need to remove the tightening bolts 8 from the lugs 7 and reattach the tightening bolts 8 to the lugs 7; and thus the attachment and replacement of the drumheads 2 is done quickly. Furthermore, since both circumferential ends of the protruding portion 21A of each one of the bolt attachment portions 21 are integrally formed with the circular plate portion 20B of the tightening frame 20, each protruding portion 21A has a sufficient strength. No bending or damage would occur when high-tension tuning is performed, and the drumheads can be stretched with a desired tension.

In the above structure, when washers are used between the tightening bolts and the tightening frame, washers and the tightening frame or the tightening bolts can be formed so as to magnetically attract each other.

More specifically, the washers 26 can be formed from a magnetic material, and the tightening frame 20 is magnetized so as to become a permanent magnet (magnetized magnetic material) after being formed from a magnetic material. In this case, the tightening bolts 8) can be of either a magnetic material or a non-magnetic material.

Alternatively, the washers 26 can be magnetized so as to become a permanent magnet after being formed from a magnetic material, and the tightening frame 20 is formed from a magnetic material. In this case, the tightening bolts 8 can be of either a magnetic material or a non-magnetic material.

In still another alternative, the washers 26 are magnetized so as to become a permanent magnet after being formed from a magnetic material, and the tightening frame 20 is likewise magnetized so as to become a permanent magnet after being formed from a magnetic material. In this case, the tightening bolts 8 are formed from either a magnetic material or a non-magnetic material.

Examples of magnetic materials include ferromagnetic materials with a large specific permeability, such as iron, nickel, cobalt, manganese, and alloys of these metals. Examples of non-magnetic materials include aluminum, stainless steel, etc.

Material combination patterns of the tightening frame 20, tightening bolts 8 and washers 26 are shown in Table 1 below.

TABLE 1

| | Tightening bolts | Washers | Tightening frames |
|---|---|---|---|
| Pattern 1 | Magnetized magnetic material | Magnetic material | Magnetic material or non-magnetic material |
| Pattern 2 | Magnetic material | Magnetized magnetic material | Non-magnetic material |
| Pattern 3 | Non-magnetic material | Magnetized magnetic material | Magnetic material |
| Pattern 4 | Magnetic material or non-magnetic material | Magnetic material | Magnetized magnetic material |
| Pattern 5 | Magnetized magnetic material | Magnetized magnetic material | Non-magnetic material |
| Pattern 6 | Non-magnetic material | Magnetized magnetic material | Magnetized magnetic material |

In cases where the tightening frame 20 and washers 26 are magnetized, it is preferable that these elements be magnetized in the direction of thickness thereof when applying a magnetic field, so that the front and back surfaces are respectively magnetized as N and S poles (or the opposite). The tightening bolts 8 are magnetized in the axial direction by applying a magnetic field in the same manner as for the tightening frame 20 and washers 26, so that the head and tip end of the shank are respectively magnetized as N and S poles (or the opposite).

FIG. 3 shows an example in which pattern 1 of Table 1 is employed. In other word, the tightening frame 20 is formed from a magnetic material such as iron or a non-magnetic material such as aluminum, and the tightening bolts 8 are formed from a magnetic material such as iron, etc. and are magnetized so as to become permanent magnets. The washers 26 are formed from a magnetic material such as iron, etc. Thus, the washers 26 are attracted at least by the tightening bolts 8 and as a result prevented from being separated from the tightening bolts 8 and lost.

More specifically, in the structure of FIG. 3, the tightening bolts 8 are permanent magnets and thus attach and hold the washers 26 with the magnetic force of the permanent magnets. Accordingly, when the tightening bolts 8 are removed and separated from the lug nuts 15 as indicated by arrow in FIG. 3 and further pulled out of the bolt attachment openings 22, the washers 26 are lifted as a unit with the tightening bolts 8. The washers 26 do not fall off of the tightening bolts 8. In patterns 2 and 5 of Table 1, the washers 26 and tightening bolts 8 are magnetically attracted in the same manner as in pattern 1, and the washers 26 do not fall off of the tightening bolts 8.

FIG. 4 shows an example in which the pattern 3 is employed. In other words, the tightening frame 20 is formed from a magnetic material such as iron, etc., and the tightening bolts 8 are formed from a non-magnetic material such as stainless steel, etc. The washers 26 are formed from a magnetic material such as iron, etc. and are magnetized so as to become permanent magnets. Thus, the washers 26 are attracted by the tightening frame 20 and as a result prevented from being separated from the tightening frame 20 and lost.

In the structure of FIG. 4, the washers 26 constitute permanent magnets and are attached to the tightening frame 20 with the magnetic force of the permanent magnets. Accordingly, when the tightening bolts 8 are removed and separated from the lug nuts 15 as indicated by arrow in FIG. 4 and further pulled out of the bolt attachment openings 22, the washers 26 are magnetically attracted by the tightening frame 20. The washers 26 do not fall off of the tightening frame 20. In patterns 4 and 6 of Table 1, the washers 26 are magnetically attached to the tightening frame 20 in the same manner as in pattern 3, and the washers 26 do not fall off of the tightening frame 20.

In pattern 6 of the Table 1, the tightening frame 20 and the washers 26 are permanent magnets. Accordingly, it is desirable that the magnetic poles on the surface of the tightening frame 20 and the magnetic pole on the undersurfaces of the washers 26 be opposite poles.

As seen from the above, according to the drum tightening frame of the present invention, there is no need to remove the tightening bolts from the lugs. Accordingly, attachment and replacement of the drumheads can be performed quickly, improving the handling characteristics of the drum. Furthermore, with a sufficient strength, there is no damage to the bolt attachment portion even if high-tension tuning is performed, so that the drumheads can be securely stretched.

Furthermore, with a use of magnetic force in at least two of three elements, the tightening bolts, washers and tightening frame, even in cases in which the tightening bolts are removed, there is no danger that the washers will fall off of the tightening bolts or of the tightening frame and become lost. Accordingly, the drumhead assembly and replacement work can be performed quickly.

What is claimed is:

1. A tightening frame for a drum, said tightening frame being mounted on an open end of a drum body of said drum that is provided with a plurality of lugs on an outer surface thereof, pressing a head frame for said drum by being connected to said lugs by tightening bolts and having a circular plate portion, wherein said circular plate portion is provided with an elongated bolt attachment openings, each of said bolt attachment openings being closed at both ends thereof and comprised of:

primary opening section that extends in a circumferential direction of said tightening frame and allows a shank portion of a tightening bolt solely to pass through, and a secondary opening section which is continuously formed at one end of said primary opening section and allows a head portion of said tightening bolt to pass through; and further comprising a washer disposed between said head of said tightening bolt and said circular plate portion of said head frame, wherein said washer and one of said tightening frame and tightening bolt are magnetically attracted to each other.

2. The drum tightening frame according to claim 1, wherein said washer is formed by a magnetized magnetic material, and one of said tightening frame and tightening bolt is formed by a magnetic material.

3. The drum tightening frame according to claim 1, wherein said washer is formed by a magnetic material, and one of said tightening frame and tightening bolts is formed by a magnetized magnetic material.

4. The drum tightening frame according to claim 1, wherein said washer is formed by a magnetized magnetic material, and one of said tightening frame and tightening bolt is formed by a magnetized magnetic material, while another of said tightening frame and tightening bolts is formed by a non-magnetic material.

* * * * *